US008256634B2

(12) United States Patent
Tanaka

(10) Patent No.: US 8,256,634 B2
(45) Date of Patent: Sep. 4, 2012

(54) SYNTHETIC RESIN BOTTLE

(75) Inventor: Toshimasa Tanaka, Tokyo (JP)

(73) Assignee: Yoshino Kogyo Co., Ltd., Tokyo (JP)

( * ) Notice: Subject to any disclaimer, the term of this patent is extended or adjusted under 35 U.S.C. 154(b) by 265 days.

(21) Appl. No.: 12/863,618

(22) PCT Filed: Jan. 14, 2009

(86) PCT No.: PCT/JP2009/050354

§ 371 (c)(1),
(2), (4) Date: Aug. 4, 2010

(87) PCT Pub. No.: WO2009/096222

PCT Pub. Date: Aug. 6, 2009

(65) Prior Publication Data

US 2010/0320218 A1 Dec. 23, 2010

(30) Foreign Application Priority Data

Jan. 31, 2008 (JP) ..... 2008-020198

(51) Int. Cl.
*B65D 1/42* (2006.01)

(52) U.S. Cl. ..... 215/381; 215/379; 215/383; 220/669; 220/671; 220/675; 220/721

(58) Field of Classification Search ..... 215/379, 215/381–384, 900; 220/666, 669, 671–673, 220/675, 721
See application file for complete search history.

(56) References Cited

U.S. PATENT DOCUMENTS 3,434,625 A * 3/1969 Embry, Jr. ..... 220/495.06
5,279,433 A * 1/1994 Krishnakumar et al. ..... 215/381
5,704,503 A * 1/1998 Krishnakumar et al. ..... 215/381
7,334,695 B2 * 2/2008 Bysick et al. ..... 215/371
2001/0030166 A1 * 10/2001 Ozawa et al. ..... 215/381
2001/0054597 A1 * 12/2001 Ozawa et al. ..... 215/381

(Continued)

FOREIGN PATENT DOCUMENTS

JP A-2005-96850 4/2005
JP A-2008-7158 1/2008

OTHER PUBLICATIONS

International Search Report for International Patent Application No. PCT/JP2009/050354, mailed on Feb. 24, 2009 (w/ English translation).

(Continued)

*Primary Examiner* — Sue Weaver
(74) *Attorney, Agent, or Firm* — Oliff & Berridge, PLC

(57) ABSTRACT

The technical problem to be solved by this invention is to create a shape of vacuum absorbing panels that can control swelling deformation involved in hot filling of synthetic resin bottles, without impairing the vacuum absorbing function of the bottles. A principle means of giving solution to this problem is a synthetic resin bottle of this invention comprising multiple vacuum absorbing panels in a dented shape disposed around a body in parallel in a circumferential direction, and also a vertical groove disposed in a laterally central area of each vacuum absorbing panel so that the vertical groove performs a function as a starting point for the deformation into a further dented state at the time of depressurization, wherein the vertical groove has a changing depth that gradually grows larger toward an upper end and a lower end, starting from a vertically central area of each vacuum absorbing panel.

8 Claims, 7 Drawing Sheets

U.S. PATENT DOCUMENTS

| | | | | |
|---|---|---|---|---|
| 2005/0247664 | A1* | 11/2005 | Lane et al. | 215/381 |
| 2008/0073315 | A1* | 3/2008 | Hermel et al. | 215/379 |
| 2008/0073316 | A1* | 3/2008 | Stowitts | 215/381 |
| 2008/0245762 | A1* | 10/2008 | Matsuoka et al. | 215/383 |

OTHER PUBLICATIONS

International Preliminary Report on Patentability for International Patent Application No. PCT/JP2009/050354, mailed on Sep. 10, 2010.

* cited by examiner

[fig. 1]
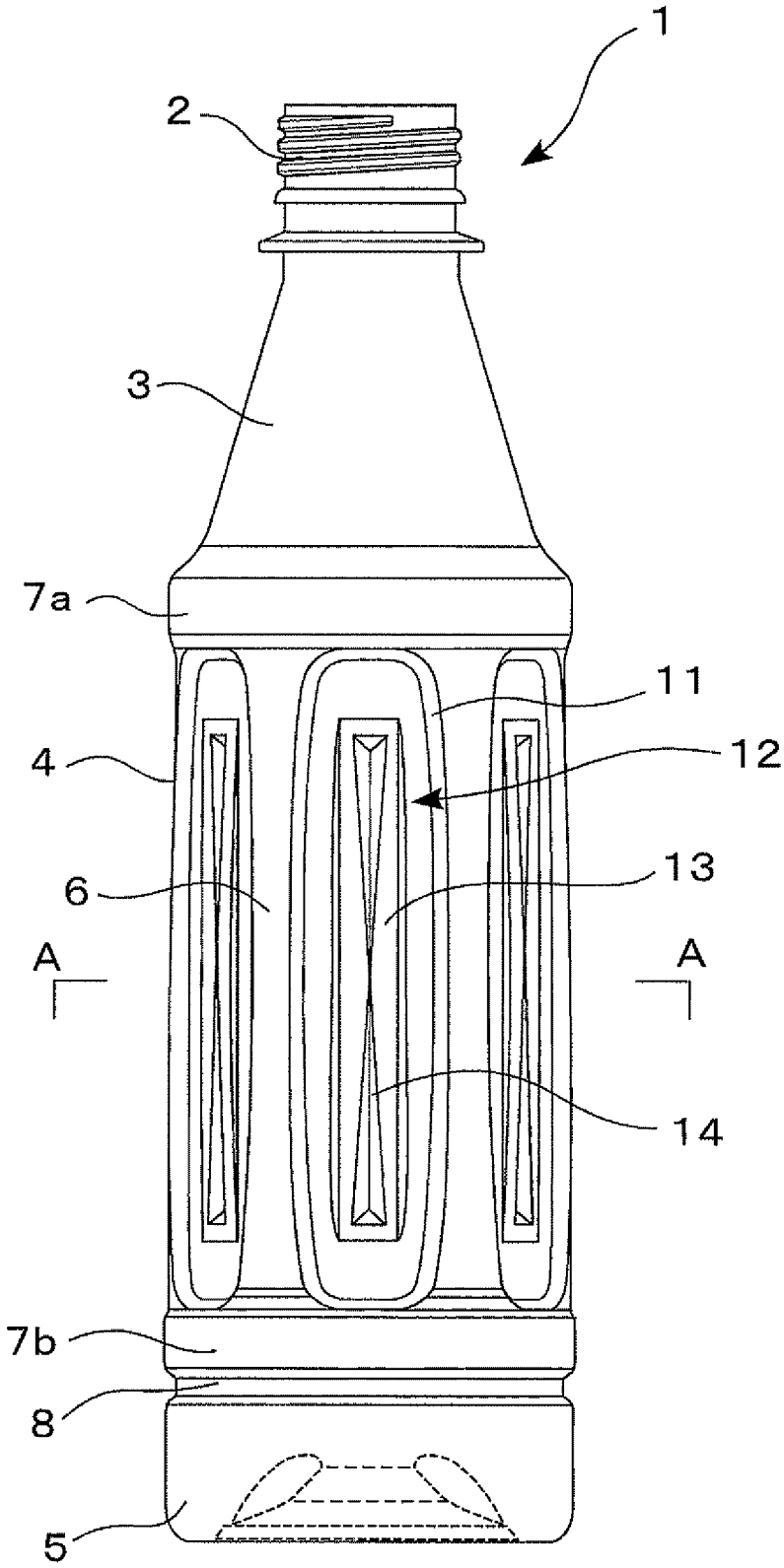

[Fig.2]
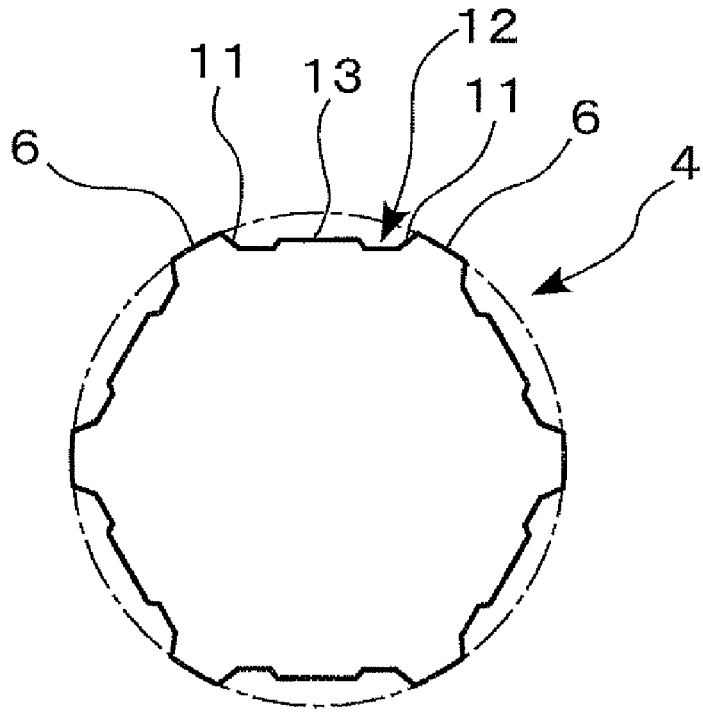

[Fig.3]
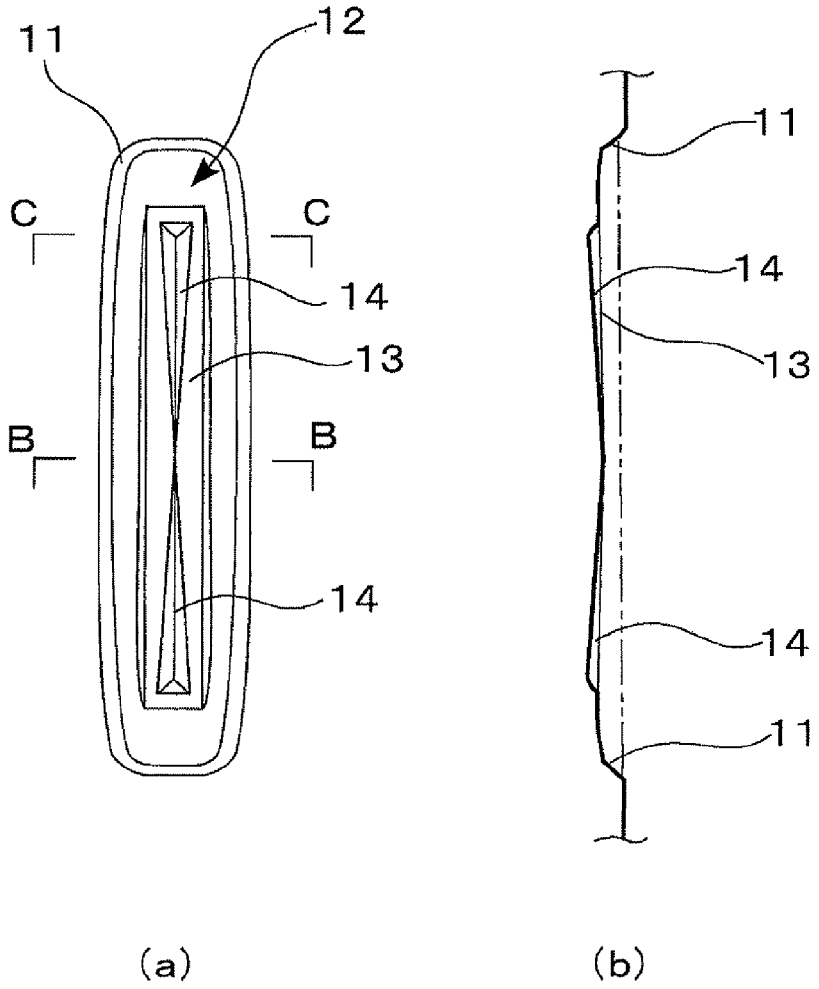
[Fig.4]
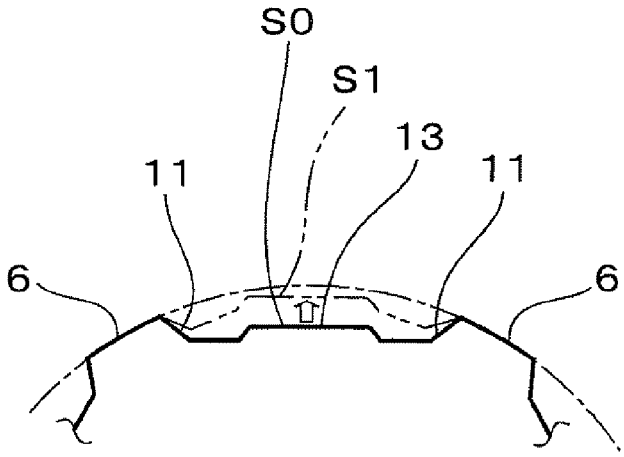

[Fig.5]
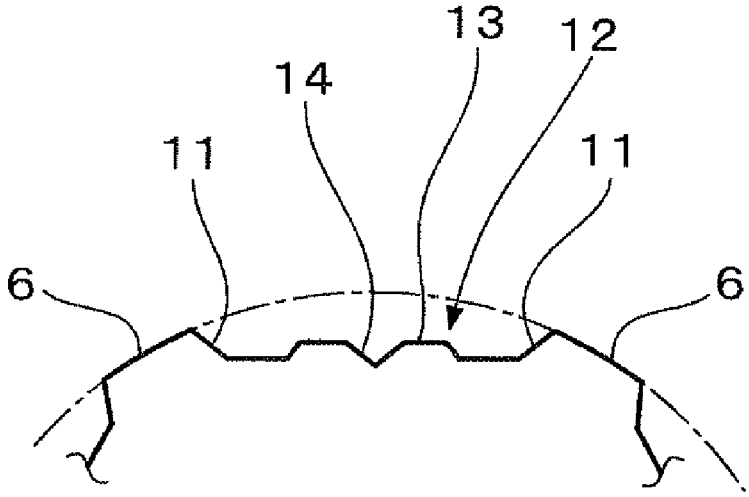

[Fig.6]
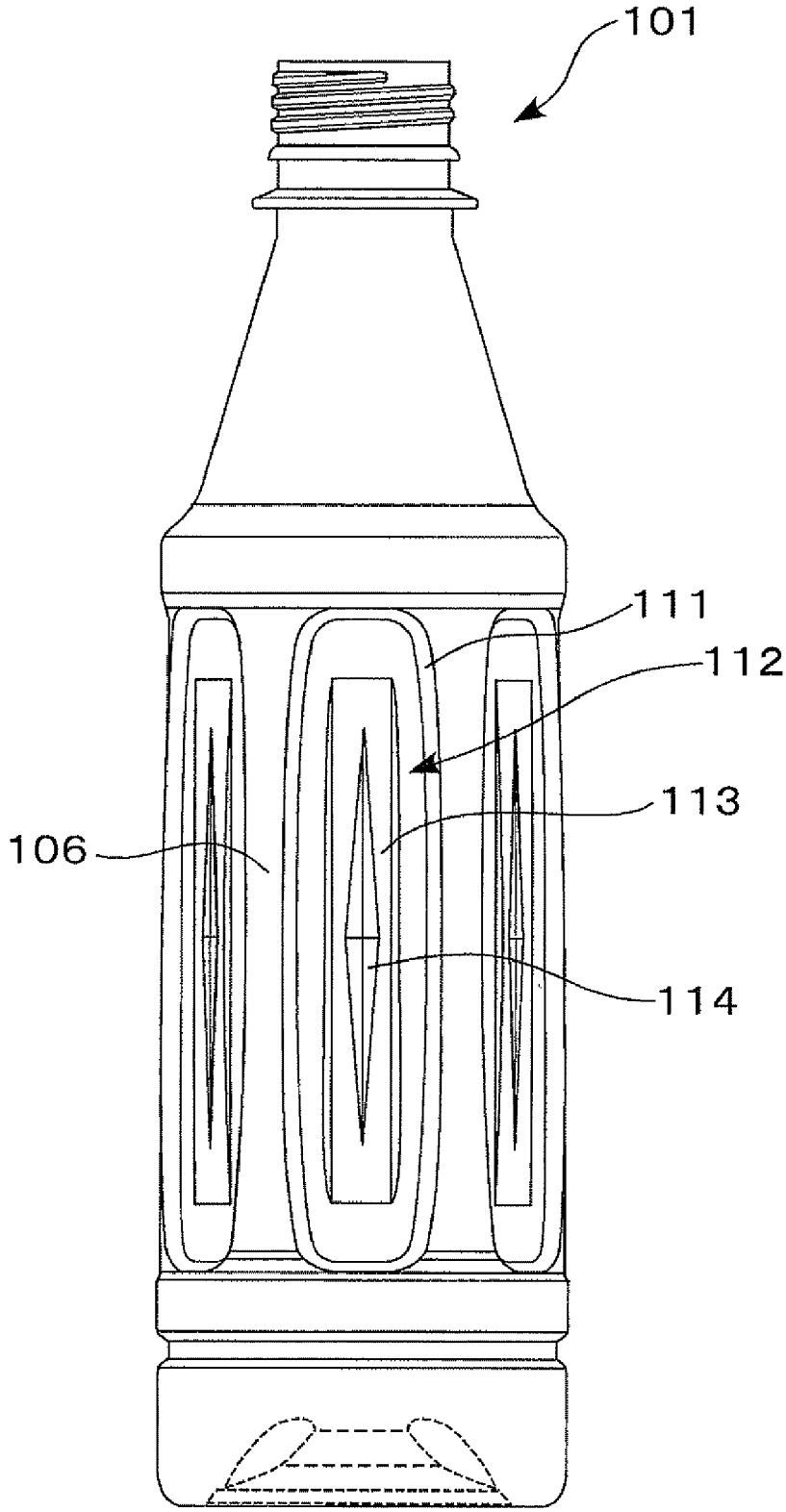

[Fig.7]
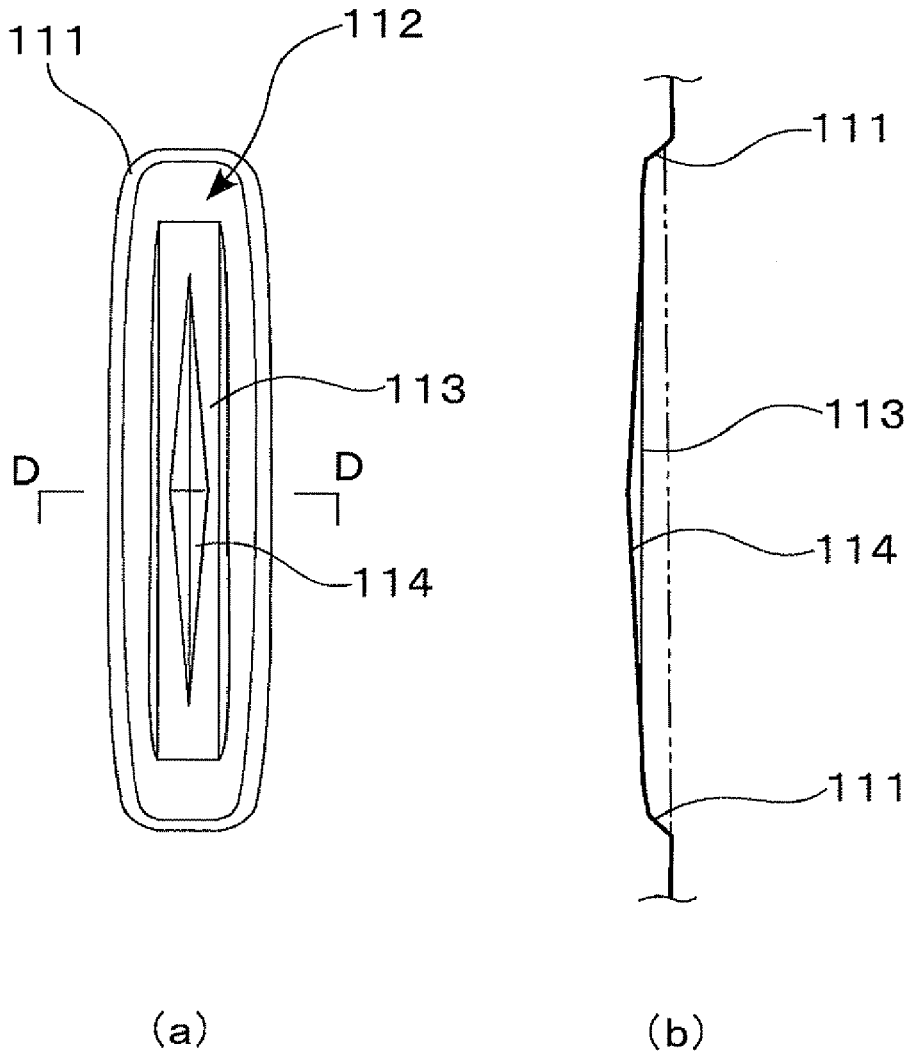

[Fig.8]
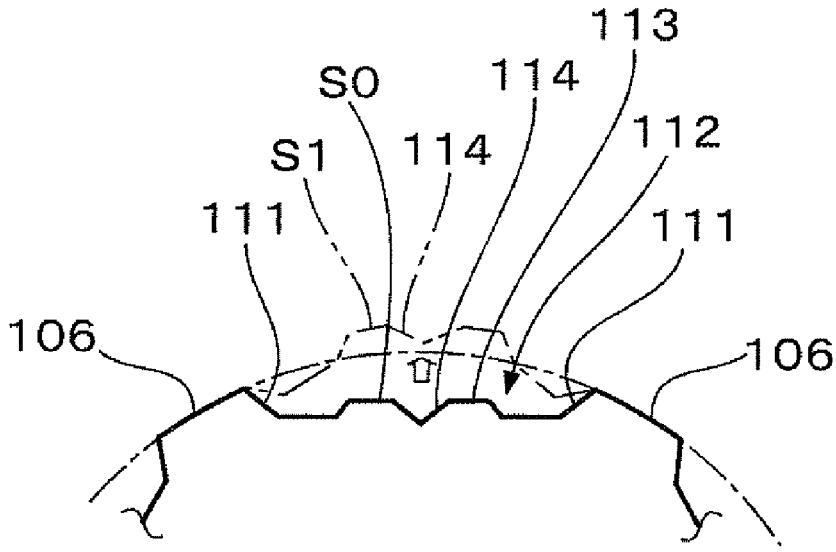

SYNTHETIC RESIN BOTTLE

TECHNICAL FIELD

This invention relates to a synthetic resin bottle having vacuum-absorbing panels around the body.

BACKGROUND ART

A method called the hot filling is conventionally known as a method of filling synthetic resin bottles, such as polyethylene terephthalate (PET) resin bottles, with juices, teas, and the like, which require sterilization. According to this method, the bottle is filled with the contents at a temperature of about 90 degrees C., then capped, sealed, and cooled. After the cooling, the inside of the bottle falls under a considerably depressurized condition.

What is called a heat-resistant bottle is used in those applications requiring the hot filling described above. Such a bottle is provided with vacuum absorbing panels around the body and has a so-called vacuum absorbing function, that is, the function of inconspicuously absorbing or easing up deformation of the bottle caused by volume reduction under reduced pressure, without giving an impression of distorted deformation. For example, Patent Document 1 describes an invention which relates to a round bottle having six vertically long vacuum absorbing panels formed in a dented shape and disposed around the body axisymmetrically on the central axis.

With bottle size or capacity becoming smaller from 500 ml to 200 ml with 350 ml and 300 ml in between, naturally the body has a smaller surface area. Then, it becomes difficult for the vacuum absorbing panels to secure the surface area required for a vacuum absorbing capacity. Thus, various proposals have been made in the past regarding the shapes of vacuum absorbing panels that can effectively perform the vacuum absorbing function. See, for example, Patent Document 1.

[Patent Document 1] Published patent application JP2003-63516

DISCLOSURE OF THE INVENTION

Problems to be Solved by the Invention

As described above, various designs of panel shapes have been proposed in the past to improve the vacuum absorbing function effectively. On the other hand, if the bottle is sealed with a cap immediately after the hot filling, the inside of the bottle becomes pressurized, and the bottle body may deform into a swelled state. Therefore, a vertical groove may be disposed in a laterally central area (along a vertical centerline) of each vacuum absorbing panel as a starting point for the deformation into a dented state so as to let the panel perform the vacuum absorbing function effectively. In such a case, this vertical groove often deforms as if it opens when the bottle is swollen due to the hot filling. This open state would not return to the original shape even after the bottle has been left standing at normal temperature. Therefore, a problem arises in that the vertical groove can never again play the role as the starting point for the deformation into the dented state at the time of pressure reduction.

This invention has been made to solve this problem. The technical problem to be solved by this invention is to create a shape of vacuum absorbing panels that can control swelling deformation involved in the hot filling of synthetic resin bottles, without impairing the vacuum absorbing function of the bottles.

Means of Solving the Problem

The synthetic resin bottle of this invention mainly comprises multiple vacuum absorbing panels in a dented shape disposed around a body in parallel in a circumferential direction, and also a vertical groove disposed in the laterally central area (along the vertical centerline) of each vacuum absorbing panel so that the vertical groove performs a function as a starting point for the deformation into a further dented state at the time of depressurization, wherein the vertical groove has a changing depth that gradually grows larger toward an upper end and a lower end, starting from a vertically central area (from a middle point of the vertical centerline) of each vacuum absorbing panel.

The vacuum absorbing panels have a dented shape and are disposed around the body in parallel in the circumferential direction. In many cases, each of these panels has a vertical groove at the laterally central area (along the vertical centerline). This vertical groove performs the function as a starting point for the panel to deform into a further dented shape at the time of depressurization and for the deformation to start from a central area of each vacuum absorbing panel and to propagate smoothly in the lateral and vertical directions. In this way, the vacuum absorbing panels are by themselves protected from deforming into a distorted shape and are allowed to perform the vacuum absorbing function satisfactorily.

On the other hand, however, the vertical groove also serves as a starting point for the vacuum absorbing panels to deform into a swelled state at the time of the hot filling. Especially in a vertically central area (an area along a lateral centerline) of each panel where there is less restraint showed by the edges of the panel, body wall swells to a large extent partly because the body has low rigidity, too, at a high temperature. Each vertical groove deforms as if it opens right and left. After this deformation, the groove does not restore its original shape even at room temperature, and can never sufficiently perform the function as the starting point for the panel to deform into a further dented state.

The above-described main feature is intended to use the upper and lower ends of the panels, rather than the central area, as the starting points for the deformation of panels into a dented or swelled state. This can be done by increasing the depth of the vertical groove gradually from the panel center to the upper and lower ends. Both end portions are restrained from the deformation caused by the edges of the vacuum absorbing panels, especially the deformation into the swelled state, and thus, the end portions can effectively control the swelling deformation involved in the hot filling. Meanwhile, in the vertically central area (the area along the lateral centerline) where there is less restraint showed by the edges of the panel, the panel has a short extensional length in the circumferential direction because the vertical groove is made to be increasingly shallow, and the panel can control the swelling deformation to a small extent.

On the other hand, the deformation into a dented state at the time of depressurization can be pressed forward smoothly to the central area by using, as the starting points, the upper and lower ends of the vertical groove where the groove has a large depth. Thus, it becomes possible to satisfy both ways of deformation: To control the deformation into the swelled state under a pressurized condition and to smooth the progress of deformation into the dented state under a depressurized condition.

Another feature of this invention comprises that, in addition to the above main feature, each of the vacuum absorbing panels has no groove at a vertically central position (at the middle point of the vertical centerline).

Due to the above feature, each vacuum absorbing panel has no groove at the vertically central position, and thus, the swelling deformation can be effectively controlled in the vertically central area.

Still another feature of this invention comprises that the vertical groove is made to grow wider as it comes toward the upper and lower ends, starting from the vertically central area of each vacuum absorbing panel.

Due to this feature, the upper and lower ends of the vertical groove can be more effectively used as the starting points for deformation, by widening, as well as deepening, the groove gradually from the vertically central area to both the upper and lower ends.

Still another feature of this invention comprises that a flat, raised portion having a flat top surface is formed at the center of each vacuum absorbing panel and that a vertical groove is formed in this flat raised portion.

Due to this feature, vacuum absorbing capacity can be increased by the reversed deformation of the flat raised portion into the dented state experienced at the time of depressurization.

Effects of the Invention

As the main feature of this invention it is intended to use the upper and lower ends of the vacuum absorbing panels, rather than the vertically central area, as the starting points for the deformation of panels into a dented or swelled state. This can be done by increasing the depth of the vertical groove gradually over a range from the vertically central area to the upper and lower ends. The main feature ensures that the swelling deformation involved in the hot filling can be effectively controlled. In addition, the deformation into a dented state at the time of depressurization can be pressed forward smoothly to the central area by using, as the starting points, the upper and lower ends of the vertical groove. Therefore, it becomes possible to control the deformation into the swelled state under a pressurized condition and to smooth the progress of deformation into the dented state under a depressurized condition, thus enabling the deformation to be controlled in both directions.

According to another feature, the vacuum absorbing panels have no groove at a vertically central position of each panel. Then, these panels ensure that the swelling deformation can be controlled more effectively in the vertically central area.

According to still another feature, the vertical groove is widened more and more as it comes to upper and lower ends from the vertically central area. Then, the upper and lower ends of the vertical groove can be more effectively used as the starting points for deformation, by widening, as well as deepening, the groove gradually over the range from the vertically central area to both the upper and lower ends.

According to still another feature, a flat raised portion having a flat top surface is formed in the central area of each vacuum absorbing panel, and a vertical groove is formed in this flat raised portion. In that case, vacuum absorbing capacity can be increased by the reversed deformation of the raised flat portion into the dented state at the time of depressurization.

BRIEF DESCRIPTION OF THE DRAWINGS

FIG. 1 is a front view of the synthetic resin bottle in one embodiment of this invention.

FIG. 2 is a cross-sectional plan view of the bottle taken along line A-A shown in FIG. 1.

FIGS. 3(*a*) and 3(*b*) are a front view and a vertical section, respectively, of a vacuum absorbing panel of the bottle shown in FIG. 1.

FIG. 4 is a cross-sectional plan view of the vacuum absorbing panel and its vicinity taken along line B-B shown in FIG. 3(*a*).

FIG. 5 is a cross-sectional plan view of the vacuum absorbing panel and its vicinity taken along line C-C shown in FIG. 3(*a*).

FIG. 6 is a front view of the synthetic resin bottle in a comparative example.

FIGS. 7(*a*) and 7(*b*) are a front view and a vertical section, respectively, of a vacuum absorbing panel of the bottle shown in FIG. 6.

FIG. 8 is a cross-sectional plan view of the vacuum absorbing panel and its vicinity taken along line D-D shown in FIG. 7(*a*).

DESCRIPTION OF REFERENCE SIGNS

1, 101. Bottle
2. Neck
3. Shoulder
4. Body
5. Bottom
6, 106. Support pillar
7*a*, 7*b*. Short end cylinder
8. Peripheral groove
11, 111. Step portion
12, 112. Vacuum absorbing panel
13, 113. Flat raised portion
14, 114. Vertical groove
SO. Ordinary state
S1. Swelled state

PREFERRED EMBODIMENTS

This invention is further described with respect to a preferred embodiment, now referring to the drawings. FIGS. 1-5 show the synthetic resin bottle in one embodiment of this invention, in which FIG. 1 is a front view; FIG. 2 is a cross-sectional plan view of the bottle 1 taken along line A-A shown in FIG. 1; FIGS. 3(*a*) and 3(*b*) are a front view and a vertical section taken along a vertical centerline, respectively, of a vacuum absorbing panel 12 of the bottle shown in FIG. 1; FIG. 4 is a cross-sectional plan view of the vacuum absorbing panel 12 and its vicinity taken along line B-B shown in FIG. 3(*a*); and FIG. 5 is a cross-sectional plan view of the vacuum absorbing panel 12 and its vicinity taken along line C-C shown in FIG. 3(*a*).

The bottle 1 is a biaxially drawn and blow molded product made of a PET resin. It has a basic shape of a round bottle with a capacity of 500 ml, and comprises a neck 2, a shoulder 3, a body 4, and a bottom 5. The bottle 1 also comprises six vacuum absorbing panels 12 in a dented shape disposed around the body in parallel in a circumferential direction. The body 4 has a hexagonal shape, as shown in the cross-sectional plan view of FIG. 2. Six support pillars 6 are disposed between neighboring vacuum absorbing panels 12 to let these support pillars 6 take charge of rigidity and buckling strength of the bottle 1. A short cylinder 7*a* is disposed at a position just on the upper ends of the vacuum absorbing panels 12. A peripheral groove 8 and another short cylinder 7*b* are disposed at the lower ends of the vacuum absorbing panels 12. These three portions perform the function as peripheral ribs that protect the body against deformation into a swelled or dented state.

The vacuum absorbing panels 12 in a vertically long rectangular shape are surrounded by respective step portions 11 and are dented inward from the support pillars 6 of the body 4. A flat raised portion 13 having a flat top surface is formed in the central area of each vacuum absorbing panel 12. In addition, a vertical groove 14 is formed at laterally central positions (along the vertical centerline) of this flat raised portion 13 over about the total height of the flat raised portion 13.

A vertically central area is on the same plane as the flat raised portion 13 and has no groove. Here, the vertical groove 14 looks as if it is divided into two upper and lower portions. Over a range from the vertically central area to each of the upper and lower ends of the groove, the vertical groove 14 deepens gradually from the groove-lacking state to a depth of 1.5 mm and also gradually widens from zero width to a lateral width of 5 mm (See FIGS. 3(*a*), 3(*b*), 4, and 5).

FIG. 6 is a front view of a bottle 101 in a comparative example prepared to clarify the features of the bottle 1 in the embodiment of this invention. The bottle 101 of this comparative example has vertical grooves in a vertically long diamond shape, which is an only difference from the vertical grooves 14 of the vacuum absorbing panels 12. Other portions of the bottle 101 remain in the same shapes as those of the corresponding portions of the bottle 1. FIGS. 7 and 8 show a vacuum absorbing panel 112 of the bottle 101 in the comparative example. FIGS. 7(*a*) and 7(*b*) are respectively a front view and a vertical section taken at the laterally central area (along the vertical centerline). FIG. 8 is a cross-sectional plan view of a vacuum absorbing panel 112 and its vicinity taken along line D-D shown in FIG. 7(*a*). As obvious from FIGS. 7 and 8, the vertical groove 114 is formed in a flat raised portion 113 to have a vertically long diamond shape. Unlike the vertical groove 14 in the above embodiment of this invention, the vertically central area of the diamond shape serves as a starting point for the panel to deform into a dented state at the time of depressurization. Over a range from the vertically central area to both upper and lower ends, the groove gradually becomes shallow and narrow, starting from a depth of 1.5 mm and a lateral width of 5 mm.

The following heat tests and the tests on vacuum absorbing capacity were conducted with the bottles 1 of the above embodiment and the bottles 101 of the comparative example.

(1) Heat Tests

Each bottle was filled with water heated to 87° C., and the capped bottle was observed for any abnormal deformation.

(2) Vacuum Absorbing Capacity Measurement Tests

Each bottle to be measured was filled with water up to the neck, and a rubber stopper equipped with a burette was fitted in the neck. A vacuum pump was activated to reduce pressure inside the bottle at a speed of 3 mmHg/sec, as measured with a manometer. When the bottle showed abnormal deformation, the degree of depressurization that was read off at that time was determined as suction strength. Vacuum absorbing capacity was calculated at the same time from a difference in the values of burette readings before and after the test. The value of 1 mmHg amounts to about 133 kPa (kiloPascal).

Results of the above tests were as follows:

(1) Heat Tests

In the case of the bottle 1 in the embodiment of this invention, a swelled state S1 for the central height position of each vacuum absorbing panel was in an extent outlined by a chain double-dashed line in FIG. 4, which is a range with no problem from the viewpoints of appearance and production line adequacy. As the bottle 1 was cooled down, the central area of the panel returned to a steady state SO, and smoothly went on to the dented state. On the other hand, in the case of the bottle 101 in the comparative example, there developed abnormal deformation in which two out of six vacuum absorbing panels 112 experienced a greatly swelled state S1 at the central height position, as outlined by a chain double-dashed line in FIG. 8. Especially the grooves 114 deformed as if they opened, and permanent deformation remained. After the bottle 101 was cooled down, the vacuum absorbing panels 112 failed to return to the steady state SO.

(2) Vacuum Absorbing Capacity Measurement Tests

The bottle 1 of this invention gave 142 mmHg of suction strength and 27 ml of vacuum absorbing capacity. The bottle 101 in the comparative example gave 133 mmHg of suction strength and 26 ml of vacuum absorbing capacity.

Test results described above established that the bottle 1 in the preferred embodiment does not impair the vacuum absorbing function, but rather improves the function more than achieved by the bottle 101 in the comparative example, and can effectively control the extent of swelling deformation at the time of the hot filling, and especially the extent to which the vacuum absorbing panels 12 are deformed into a swelled state at the central height positions. The tests also proved that the bottle 1 has a greatly improved heat resisting property.

This invention has been described above with respect to a preferred embodiment and its action and effect. It is to be understood, however, that this invention should not be construed as imitative only to this embodiment. A round 500-ml bottle made of a PET resin was shown in the above embodiment. The action-and-effects of this invention are fully brought out also for those bottles made of other synthetic resins, small- or large-size bottles, or square bottles in addition to round ones.

The vertical groove may be able to have various shapes within the scope in which the groove depth is increased over a range from the vertically central area to the upper and lower ends of each vacuum absorbing panel, taking into account increased rigidity and design aspect, in addition to the function as the starting points for deformation into a swelled or dented state. For instance, the vertically central area does not necessarily be a groove-lacking area as found in this embodiment. The groove may have the same width along its entire length, and can gradually deepen more as the groove comes closer to both ends. Two vertical grooves may be disposed in parallel in the laterally central area. Or, a vertical groove may be in vertical segments apart from each other.

INDUSTRIAL APPLICABILITY

As described above, the synthetic resin bottle of this invention effectively controls the extent of swelling deformation at the time of the hot filling, without impairing the vacuum absorbing function performed by the vacuum absorbing panels, and has also an improved heat resisting property. Thus, wide applications of use are expected in the product fields requiring a hot filling step.

The invention claimed is:

1. A synthetic resin bottle of this invention characterized by comprising multiple vacuum absorbing panels in a dented shape disposed around a body in parallel in a circumferential direction, and also a vertical groove formed in a laterally central area of each vacuum absorbing panel, so that the vertical groove performs a function as a starting point for deformation into a further dented state at a time of depressurization, wherein the vertical groove has a changing depth that gradually grows larger toward an upper end and a lower end, starting from a vertically central area of each vacuum absorbing panel.

2. The synthetic resin bottle according to claim 1 wherein the vacuum absorbing panels have no groove at a vertically central position of these panels.

3. The synthetic resin bottle according to claim 2 wherein the vertical groove is made to grow wider as it comes toward the upper and lower ends, starting from the vertically central area of each vacuum absorbing panel.

4. The synthetic resin bottle according to claim 1 wherein the vertical groove is made to grow wider as it comes toward the upper and lower ends, starting from the vertically central area of each vacuum absorbing panel.

5. The synthetic resin bottle according to claim 2 wherein a flat raised portion having a flat top surface is formed in a central area of each vacuum absorbing panel and wherein the vertical groove is formed in this flat raised portion.

6. The synthetic resin bottle according to claim 4 wherein a flat raised portion having a flat top surface is formed in a central area of each vacuum absorbing panel and wherein the vertical groove is formed in this flat raised portion.

7. The synthetic resin bottle according to claim 3 wherein a flat raised portion having a flat top surface is formed in a central area of each vacuum absorbing panel and wherein the vertical groove is formed in this flat raised portion.

8. The synthetic resin bottle according to claim 1 wherein a flat raised portion having a flat top surface is formed in a central area of each vacuum absorbing panel and wherein the vertical groove is formed in this flat raised portion.

* * * * *

UNITED STATES PATENT AND TRADEMARK OFFICE

CERTIFICATE OF CORRECTION

PATENT NO. : 8,256,634 B2
APPLICATION NO. : 12/863618
DATED : September 4, 2012
INVENTOR(S) : Toshimasa Tanaka It is certified that error appears in the above-identified patent and that said Letters Patent is hereby corrected as shown below:

On the Title Page Item (73) should read

-- (73) Assignee: Yoshino Kogyosho Co., Ltd., Tokyo (JP) --

Item (86) should read

-- (86) PCT No. PCT/JP2009/050354
§ 371 (c)(1),
(2), (4) Date: July 20, 2010 --

Signed and Sealed this
Sixth Day of November, 2012

David J. Kappos

David J. Kappos
*Director of the United States Patent and Trademark Office*